US006949886B2

(12) United States Patent
Blakeslee, Jr.

(10) Patent No.: US 6,949,886 B2
(45) Date of Patent: Sep. 27, 2005

(54) DYNAMIC DISPLAYS

(75) Inventor: Kenneth L. Blakeslee, Jr., Marietta, GA (US)

(73) Assignee: Neon Technologies, Inc., Tucker, GA (US)

( * ) Notice: Subject to any disclaimer, the term of this patent is extended or adjusted under 35 U.S.C. 154(b) by 0 days.

(21) Appl. No.: 10/180,677

(22) Filed: Jun. 26, 2002

(65) Prior Publication Data

US 2003/0025461 A1 Feb. 6, 2003

Related U.S. Application Data

(60) Provisional application No. 60/303,973, filed on Jul. 9, 2001.

(51) Int. Cl.[7] ..... H05B 37/02

(52) U.S. Cl. ..... 315/224; 315/209 R; 315/244; 315/291; 315/307; 315/DIG. 7

(58) Field of Search ..... 315/156, 158, 315/119, 209 R, 290, 360, 307, 127, 224, 244, 291, DIG. 7

(56) References Cited

U.S. PATENT DOCUMENTS 4,847,536 A * 7/1989 Lowe et al. ..... 315/127
5,030,887 A * 7/1991 Guisinger ..... 315/307
5,070,279 A * 12/1991 Garbowicz et al. ..... 315/289
5,111,115 A * 5/1992 Ball et al. ..... 315/239
5,519,289 A * 5/1996 Katyl et al. ..... 315/224

* cited by examiner

*Primary Examiner*—James Vannucci
*Assistant Examiner*—Jimmy T. Vu
(74) *Attorney, Agent, or Firm*—Kilpatrick Stockton LLP; James L. Ewing, IV

(57) ABSTRACT

Gas discharge tube displays according to the present invention control power applied to the tubes using isolator/switches, which can be opto-isolators in combination with triacs, FET's or other semiconductor switching devices or devices which can form part of a switching circuit. Such displays can also use, if desired and if appropriate, isolators which also act as the switch without other switching devices or circuits to switch and otherwise control activation of the tubes on the secondary side, or high voltage side, of the power source or sources feeding the tubes. They may also use such switching devices or circuits which act as both the isolator and the switch. The opto-isolators separate or isolate the low voltage control circuitry from the high voltage tube power circuitry, in conjunction with a triac, FET, thyristor or other device, preferably a semiconductor device, that is adapted to withstand the power load yet accomplish the switching necessary to control activation of the tube in real time. The switching devices are adapted to shunt power from the tubes, bypass the tubes, or otherwise remove power from the tubes in order to control illumination of the tubes in order to produce a dynamic display. The isolators/switches are preferably controlled by a controller which is adapted to receive instructions and content, either from a local or remote source, in order to create and display content on the display.

17 Claims, 9 Drawing Sheets

MULTIPLE OPTO/TRIAC COMBINATIONS TO CONTROL LAMPS REQUIRING HIGHER VOLTAGE

3--OPTO ISOLATOR/TRIACS PER SINGLE LAMP CONTROL

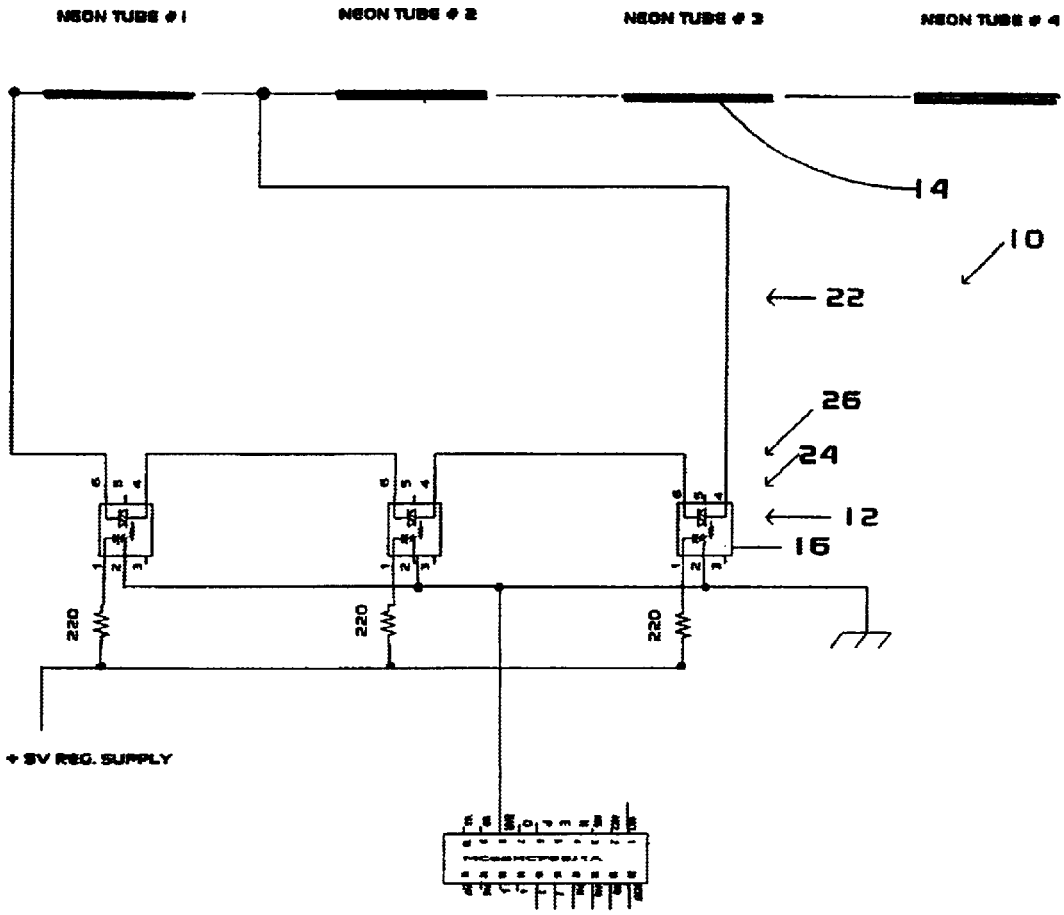
3--OPTO ISOLATOR/TRIACS PER SINGLE LAMP CONTROL
ARGON-MERCURY TUBES--EGL T8CMC & 8CMC ELECTRODES
MAXIMUM LAMP FOOTAGES PER CONTROL
8mm DIAMETER TUBING 8' 0"
10mm DIAMETER TUBING 11' 6"
13mm DIAMETER TUBING 14' 0"
FIG-3-B LOW VOLTAGE MULTIPLE-TUBE CONTROL
ISOLATED FROM HIGH VOLTAGE NEON SUPPLY
BY OPTO-ISOLATORS OPEN ANIMATED----TRANSFORMER IN MIDDLE
SINGLE OPTO-ISOLATOR / TRIAC COMBINATION SWITCH
TO CONTROL MULTIPLE NEON TUBES WITH
LOW VOLTAGE POWER SUPPLY FOR CONTROLS NEON LAMP CONTROL
HIGH FREQUENCY ELECTRONIC TRANSFORMERS
OPTO-ISOLATORS WITH FIELD EFFECT TRANSISTORS [ FET'S]

NEON LAMP CONTROL
HIGH FREQUENCY ELECTRONIC TRANSFORMERS
OPTO-ISOLATORS WITH FIELD EFFECT TRANSISTORS [ FET'S ]
COMBINATIONS TO CONTROL HIGHER VOLTAGE/TUBE LENGTH REQUIREMENTS

NEON LAMP CONTROL
HIGH FREQUENCY ELECTRONIC TRANSFORMERS
OPTO-ISOLATORS WITH FIELD EFFECT TRANSISTORS [ FET'S ]
COMBINATIONS TO CONTROL HIGHER VOLTAGE/TUBE LENGTH REQUIREMENTS

DYNAMIC DISPLAYS

Priority is hereby claimed in and to U.S. provisional patent application No. 60/303,973 filed Jul. 9, 2001, entitled, "Dynamic Neon Technology," which application is incorporated herein by this reference.

A. FIELD

Control of multiple gas-discharge tubes (such as neon or argon/mercury) for the purpose of creating a display, by controlling the secondary side of a transformer that feeds a plurality of the tubes.

B. BACKGROUND

Conventional switching devices for gas discharge tube displays, such as those using neon tubes, are either mechanical or electronic devices that control the primary (low-voltage) side of the transformers. A significant problem with this approach, among other problems, is that it requires a transformer for each tube. Multiple such transformers multiply the complexity, cost and weight of the display.

Some mechanical type devices have been used to switch tubes on the secondary side of the transformer. However, among other problems, this approach produces significant R.F.I. (radio frequency interference) and/or E.M.I. (Electromagnetic interference).

C. SUMMARY

Various embodiments of gas discharge tube displays according to the present invention use a plurality of isolator/switches, which can be opto-isolators in combination with triacs or FET's, to switch and otherwise control activation of the tubes on the secondary side, or high voltage side, of the power source or sources feeding the tubes. The opto-isolators separate or isolate the low voltage control circuitry from the high voltage tube power circuitry, in conjunction with a triac, FET, thyristor or other device, preferably a semiconductor device, that is adapted to withstand the power load yet accomplish the switching necessary to control activation of the tube in real time. The switching devices are adapted to shunt power from the tubes, bypass the tubes, or otherwise remove power from the tubes in order to control illumination of the tubes in order to produce a dynamic display.

Among other advantages and results, displays according to various embodiments of the invention reduce the number of transformers required to power the tubes, with consequent savings in size, cost and weight of the electronics necessary to support the display, together with increased electrical efficiency.

Because such displays may be controlled by one transformer or power supply, or only a minimal number of transformers or power supplies, they may include more tubes than conventional switched displays, limited essentially only by the total tube length that the power source is adapted to illuminate.

Displays according to various embodiments of the present invention also avoid the RFI and EMI inherent in mechanically-switched gas charge tube displays.

Other objects, features and advantages of the present invention will become apparent with respect to the remainder of this document.

D. BRIEF DESCRIPTION

FIG. 3*b* is a schematic diagram that shows a fourth embodiment of displays according to the present invention, in which the isolator/switches do not include a triac or switching device other than the high power side of the opto-isolators.

Figure 4:
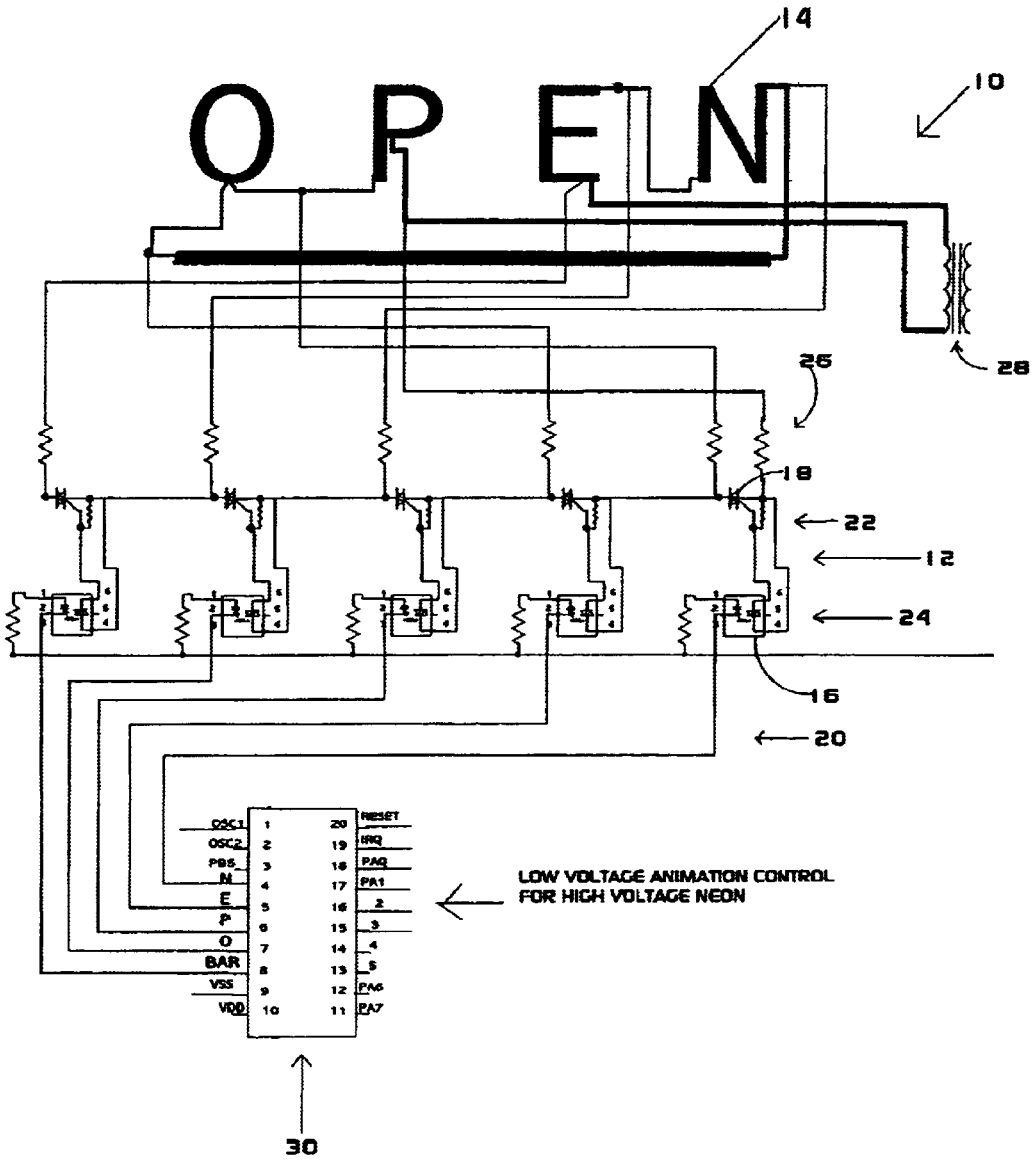

FIG. 4 is a schematic diagram that shows a fifth embodiment of displays according to the present invention, in which multiple isolator/switches, and a single power supply, control multiple gas discharge tubes to form a dynamic display that reads, "OPEN."

Figure 5:
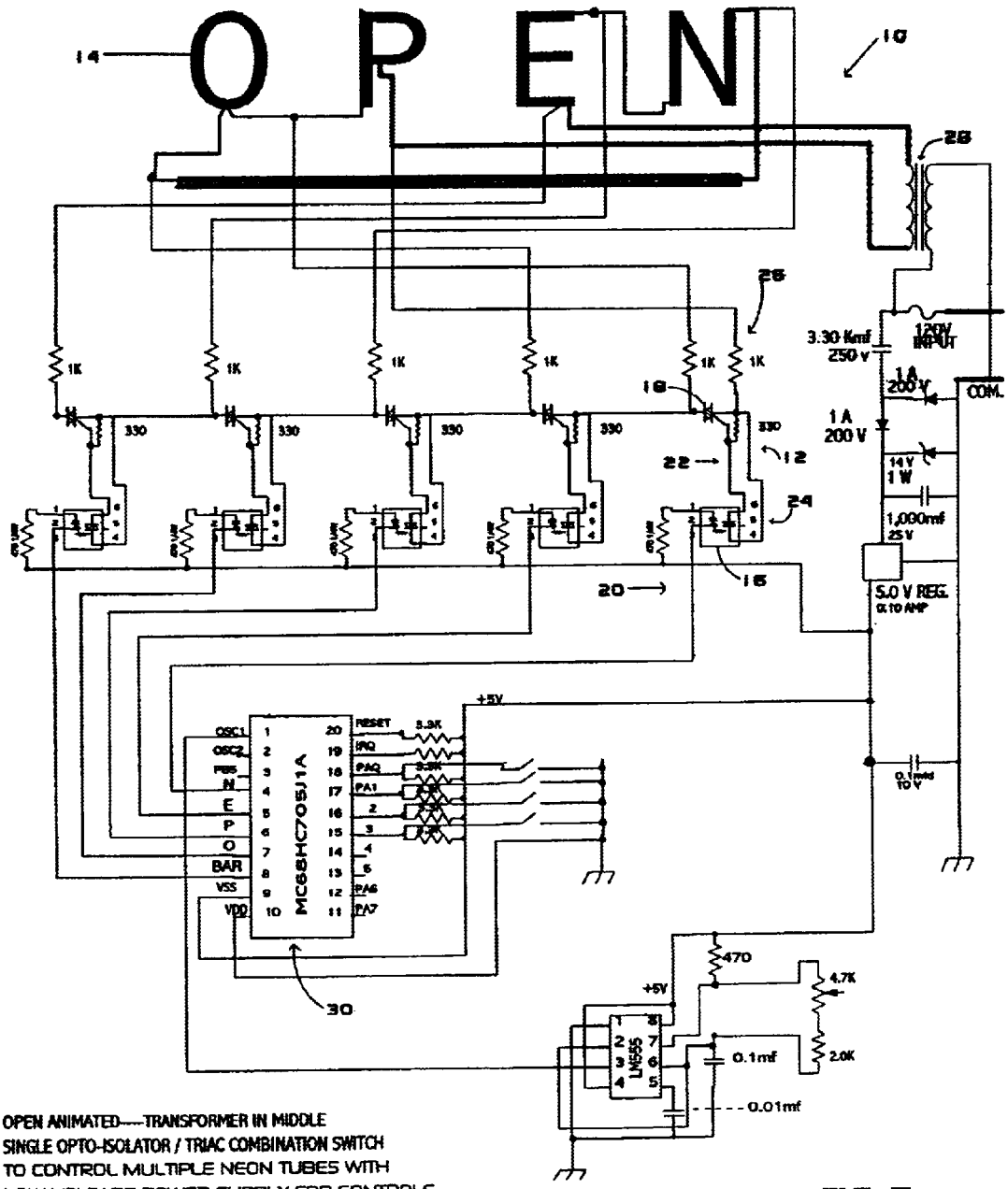

FIG. 5 is a schematic diagram that shows a sixth embodiment of displays according to the present invention, in which multiple isolator/switches, and a single power supply, together with a programmable device, control multiple gas discharge tubes to form a dynamic display that can cause various letters of the word "OPEN" to illuminate in desired sequences.

Figure 6:
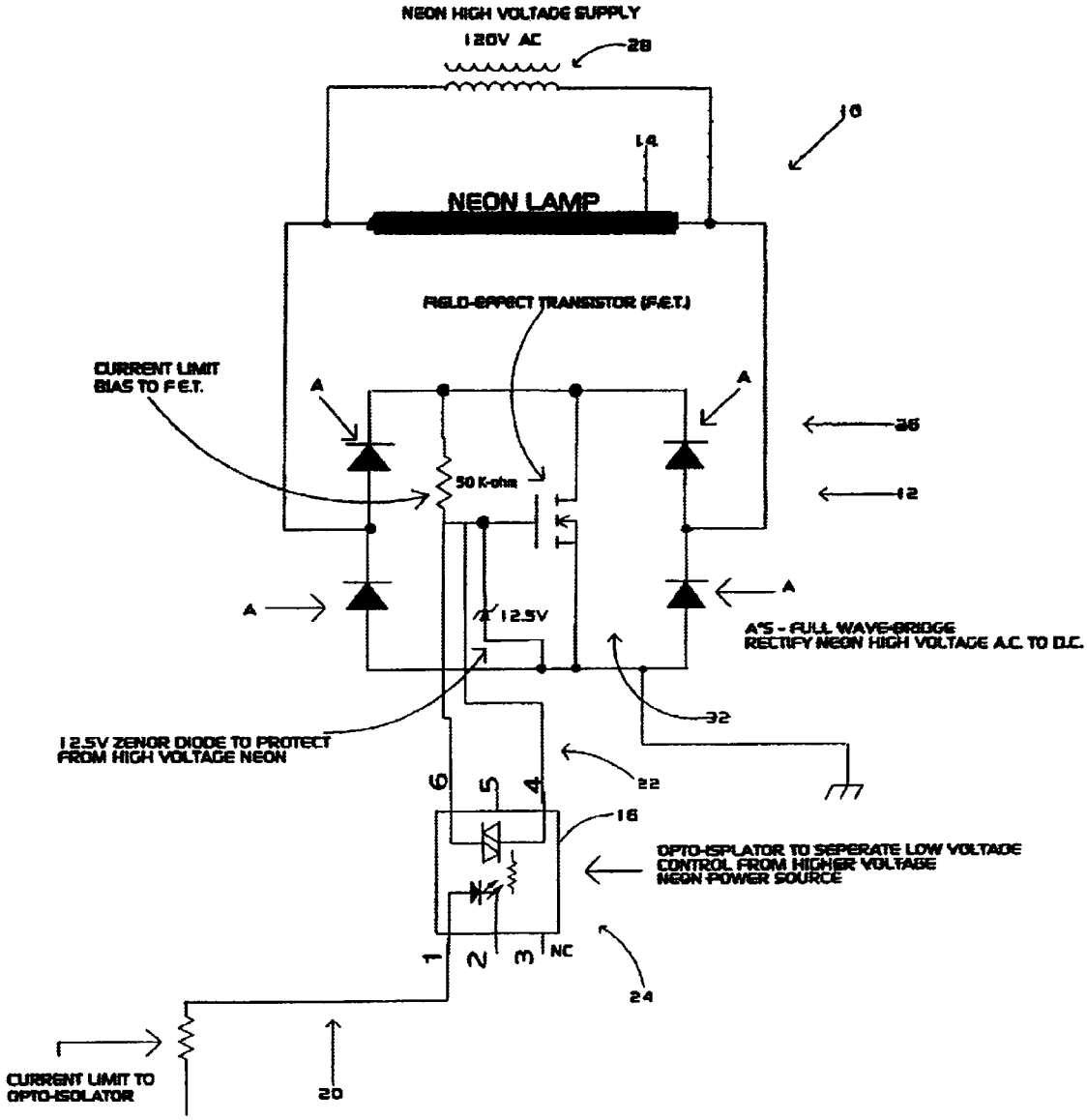

FIG. 6 is a schematic diagram that shows a seventh embodiment of displays according to the present invention, an isolator/switch that uses field effect transistors ("FET's") instead of triacs.

Figure 7:
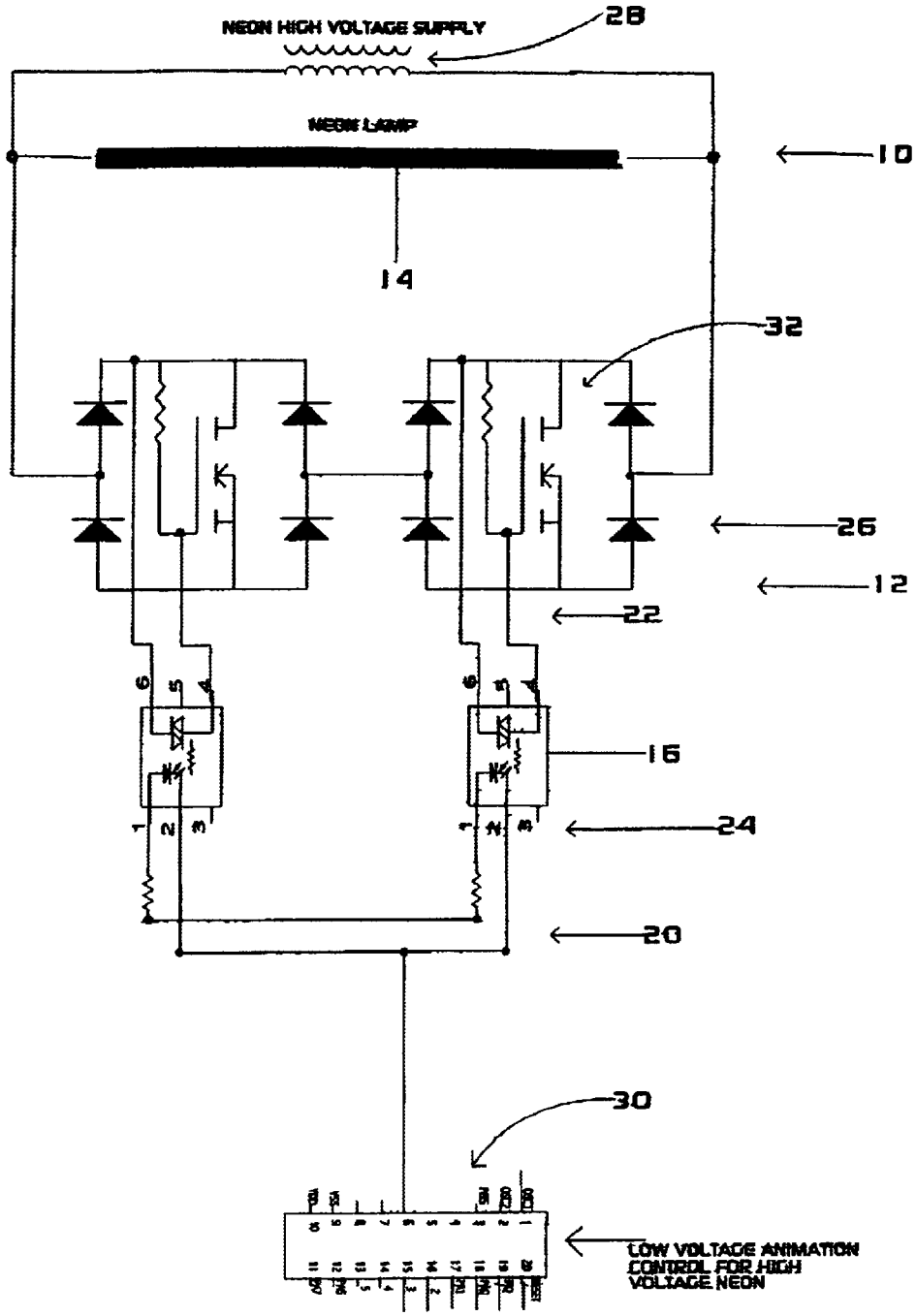

FIG. 7 is a schematic diagram that shows an eighth embodiment of displays according to the present invention that uses multiple combinations of FET's to control operation of a tube.

Figure 8:
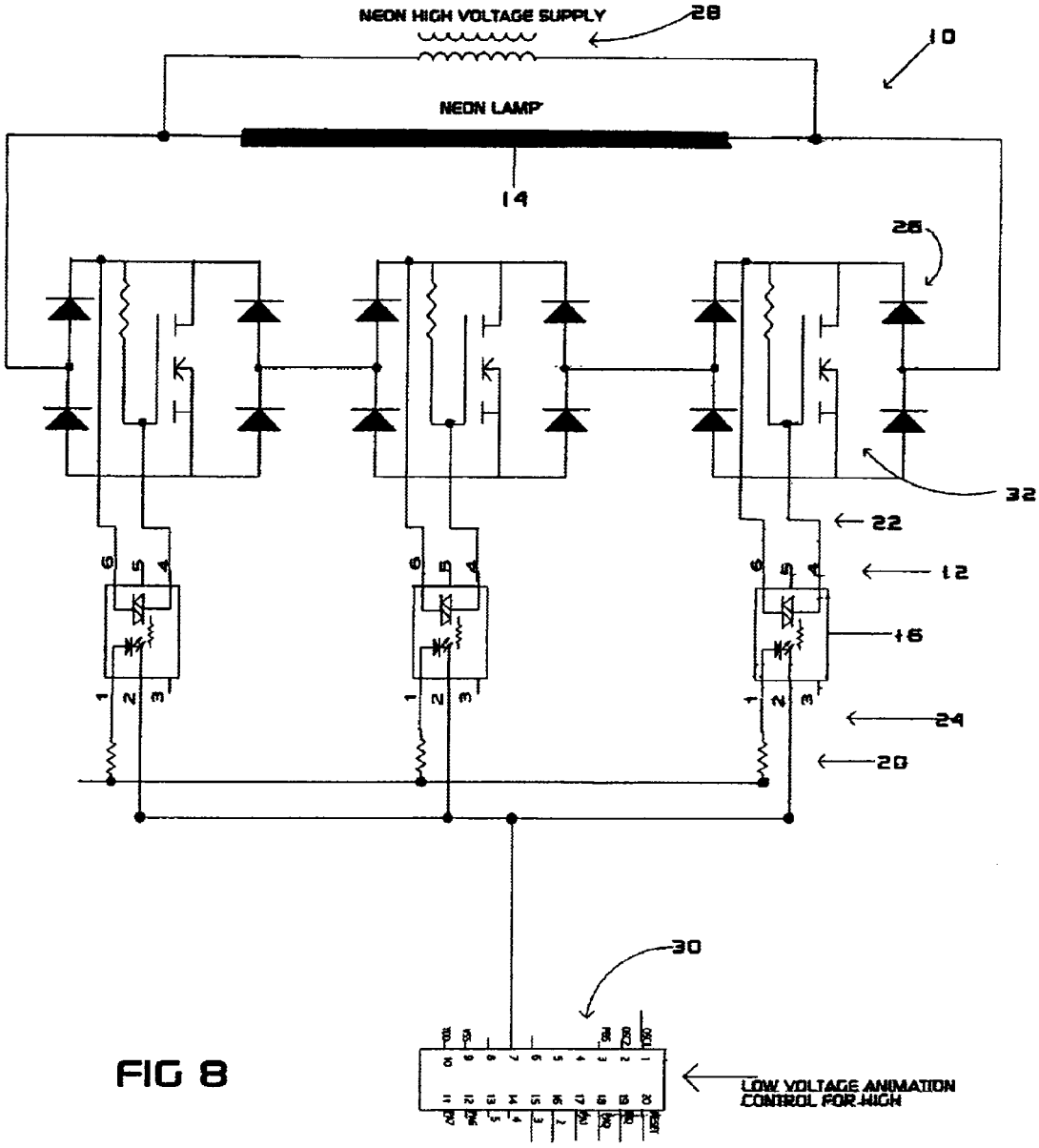

FIG. 8 is a schematic diagram that shows a ninth embodiment of displays according to the present invention that uses multiple combinations of FET's to control operation of a tube.

E. DETAILED DESCRIPTION

Figure 1:
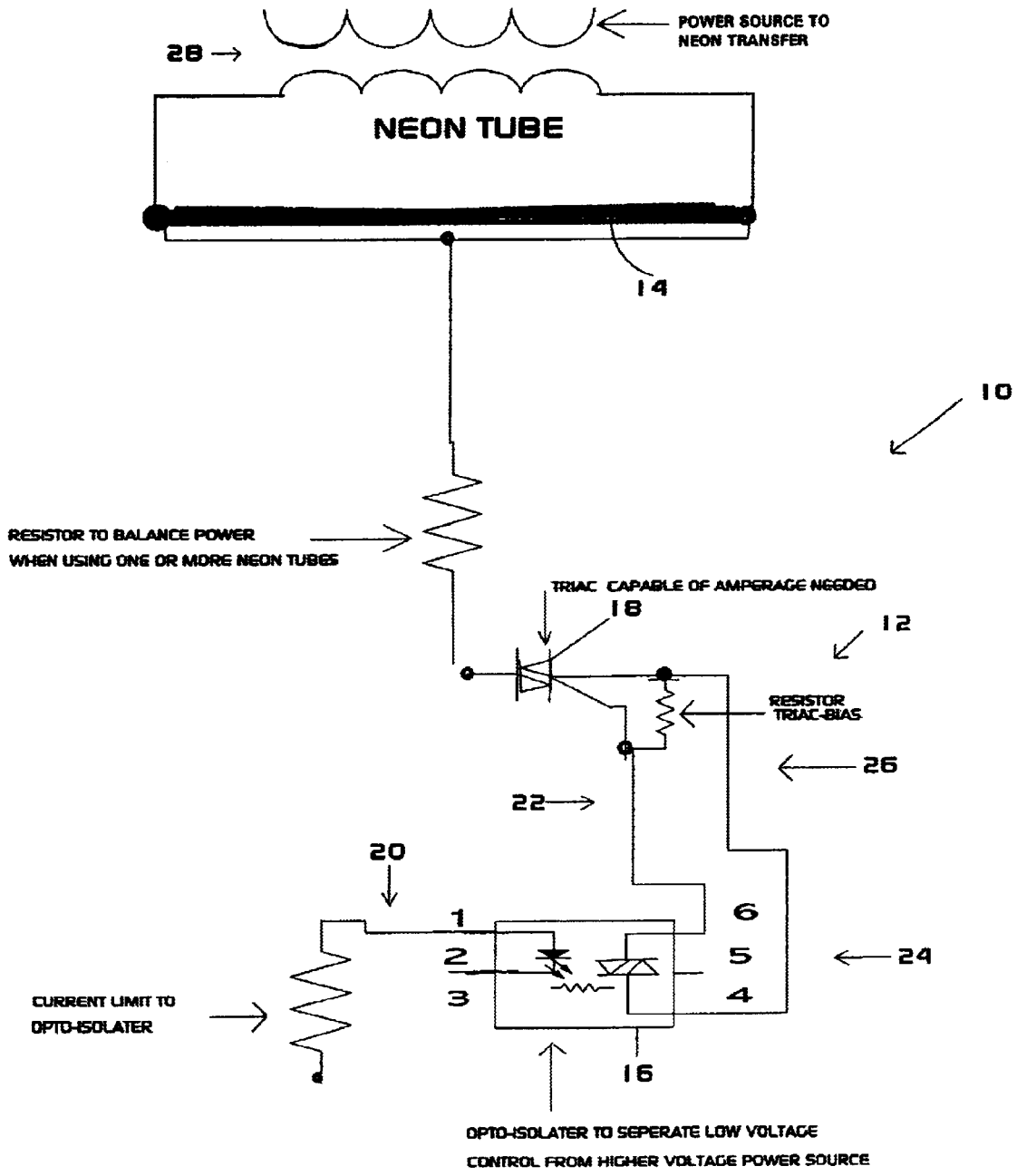
FIG. 1 is a schematic diagram that shows a first embodiment of displays according to the present invention, one form of isolator/switch which can be combined with others to control a gas discharge tube.

FIG. 1 shows a first embodiment of displays 10 according to the present invention, an isolator/switch 12 which may be combined with others to control operation of tubes 14 in the display 10. Here, the isolator/switch 12 includes an opto-isolator 16 and a triac 18. The opto-isolator 16 (which may be a single component) is used to isolate or separate low power control electronic circuits 20 from higher powered power circuits 22 (hereinafter, "isolate"). The isolator 24, which may be any sort of device that is capable of isolating or separating low voltage control circuits from higher power power circuits, is used in conjunction with a switch 26 that shunts or otherwise removes power from the gas discharge tube 14; in this embodiment, the switch 26 is a triac 18. The switch 26 may be any device, preferably semiconductor, that can accommodate the higher power necessary to illuminate a desired length of gas discharge tube 14 and that preferably switches bidirectionally. Suitable switches 26 which may be used according to the present invention in this embodiment or others include but are not limited to triacs, FET's, semiconductor controlled rectifiers (SCR's) (thyristors), PIN diodes, other transistors or semiconductor devices, and combinations of these in bridge or other relationships to accomplish the switching and power requirements needed to shunt or remove power from the gas discharge tube 14. Isolator/switches 12 may take the form of opto-isolators 16 without triacs 18 or other switches 26, other than the high power side of the opto-isolators 16 in instances where the high power side of the opto-isolators 16, or combinations of them (such as in FIG. 3*b*, for instance) are able to handle the load necessary to shunt or otherwise remove some or all power to tube 14 in order to control its illumination/deillumination ("turn the tube on" and "turn the tube off").

In the embodiment shown in FIG. 1, the low voltage side, pins #1 and #2, of the opto-isolator 16 may be triggered by the use of a microcontroller 30, which may be any desired type of processor, controller, or programmable device. Internal to the opto-isolator 16 is an LED (Light emitting diode) that turns off/on the triac 18 on the high voltage side 22 of the opto-isolator 16 (PINS #4 and #6). The opto-isolator 16 then triggers a triac 18 capable of accommodating the current and power necessary to illuminate the gas discharge tube 14, which (among other things) reduces the heating effect in the opto-isolator 16. Tube lighted/unlighted selection is performed by shunting/diverting the voltage and current around the tube 14 or otherwise removing at least a portion of the power from the tube 14 through or using the isolator/switch 12.

Figure 2:
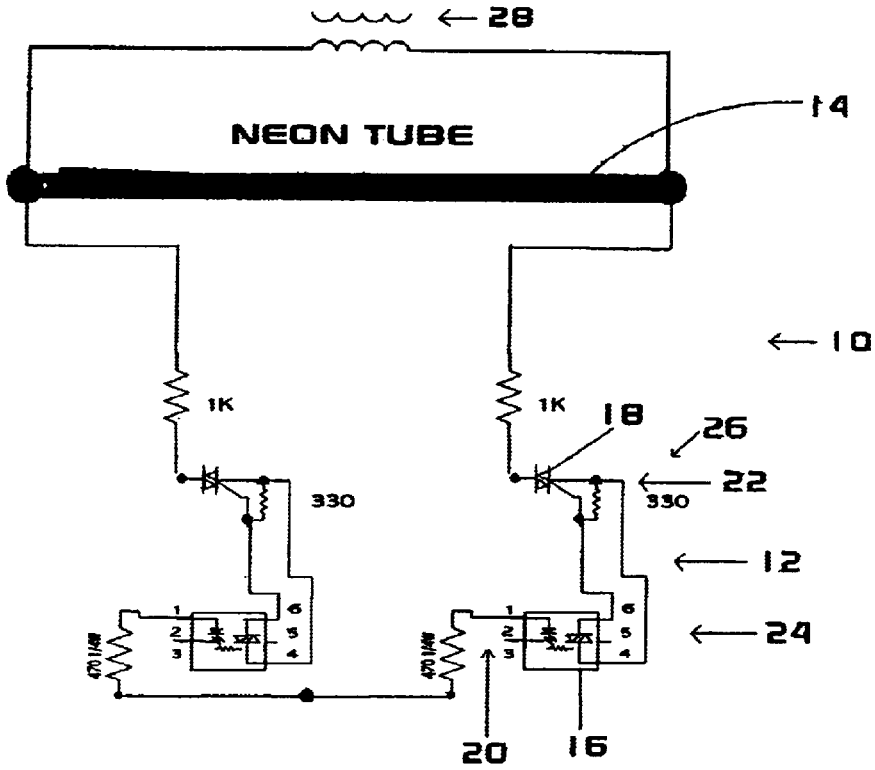
FIG. 2 is a schematic diagram that shows a second embodiment of displays according to the present invention, in which two isolator/switches control a gas discharge tube.

FIG. 2 shows a second embodiment of displays 10 according to the present invention. As the diameter of the tube 14 and/or the tube length varies, voltage requirements to illuminate the tube 14 may increase. When the voltage, current or power requirement exceeds the capability of the isolator/switch 12 (here the opto-isolator/triac combination), the isolator/switch 12 can remain in the shorted/shunted condition not allowing the tube 14 to light. According to the present invention, this situation may be addressed by combining or connecting multiples of the isolator/switches 12 as shown in FIG. 2 (here with high power sides connected in series) or as otherwise desired to increase voltage tolerance, current tolerance, power tolerance, or any of these, to allow for shunting or removing some or all power from tube 14 in order to turn it on and off.

Figure 3:
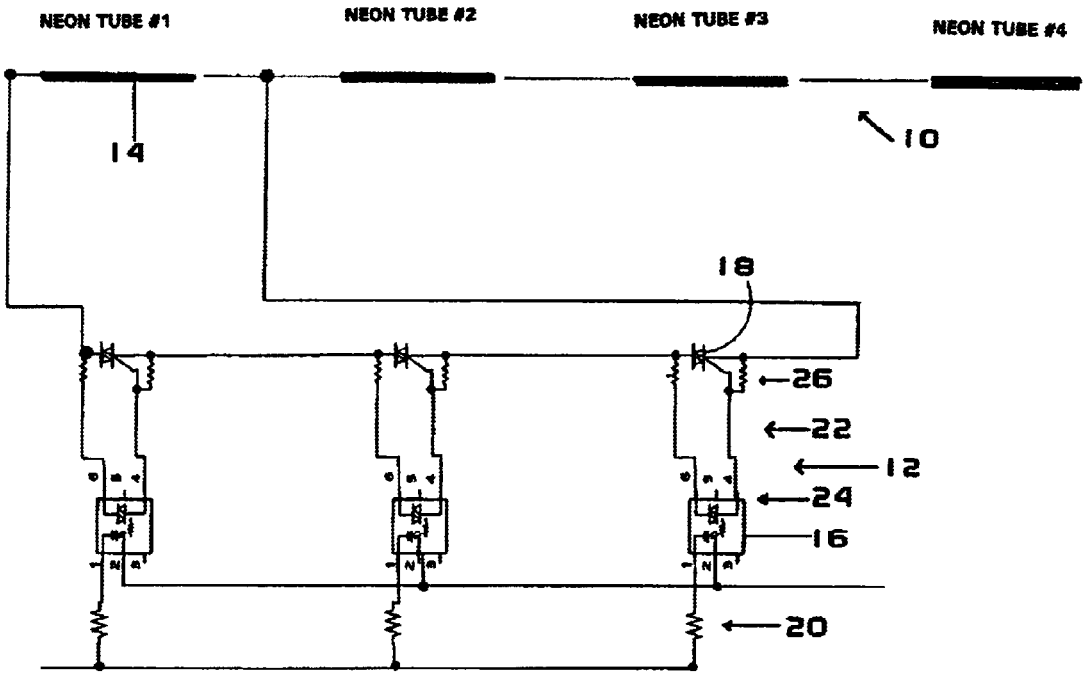
FIG. 3 is a schematic diagram that shows a third embodiment of displays according to the present invention, in which three isolator/switches control a gas discharge tube.

FIG. 3 shows a third embodiment of displays 10 according to the present invention in which three isolator/switches 12 control operation of one tube 14.

FIG. 3*b* shows a fourth embodiment of displays 10 according to the present invention that corresponds to FIG. 3 thematically, but in which opto-isolators 16 act as the isolator/switches 12 without the need for triacs 18 or other switching devices 26.

FIG. 4 shows a fifth embodiment of displays 10 according to the present invention in which multiple neon/argon tubes 14 are controlled by a microcontroller 30 or other type low voltage control. An opto-isolator/triac isolator/switch 12 is used for each tube and separates the high voltage neon tube from the lower voltage control device.

FIG. 5 shows a sixth embodiment of displays 10 according to the present invention in which the display 10 is a dynamic neon display. In this case a capacitor type power supply is used to supply the low voltage required to operate the microcontroller and controller timer. Other type power supplies such as low voltage transformers may be used depending on overall power requirements. Sequencing of illumination of neon tubes 14 may be controlled by manipulating switches controlling power to pins on the microcontroller 30, shown as pins PAQ, PA1, 2 and 3. The microcontroller 30 may be programmable either locally or remotely (and/or if desired, fed content from a local or remote source) to vary operation of the display 10 depending on user preferences, ambient conditions (e.g., temperature, humidity), external information, or other factors.

FIG. 6 shows a seventh embodiment of displays 10 according to the present invention, which uses high frequency output neon transformers. In such cases, a triac 18 will not tolerate the DV/DT—high rate of rise of the transformer. Therefore, a combination of field effect transistors (FET's) 32 can be used as the switch in order to accommodate the high frequency. Since a transistor is a unilateral device, a full-wave bridge is required to rectify the neon AC (alternating current) to DC (direct current) in order for the transistor to operate properly. A zener diode may be used at the base/gate of the transistor to prevent over-voltage from the high voltage neon. The base/gate of the transistor is controlled by the isolator 24 separating high voltage neon from the low voltage control.

FIG. 7 shows an eighth embodiment of displays 10 according to the present invention. As in the case of triacs 18, FET's 32 have a limited voltage tolerance. The FET/full-wave bridge combination may be connected with another or others in order to achieve voltage required to operate the tube 14 in the on/off condition.

FIG. 8 shows a ninth embodiment of displays 10 according to the present invention. This figure shows another example of how the FET full wave bridge combination may be connected to meet neon tube voltage requirements.

Implementation of Various Aspects of Some or All Embodiments Shown in FIGS. 1–8.

The following disclosure applies to some or all aspects or some or all embodiments of displays according to the present invention. Electronic components may be driven by a 5V regulated power supply regulated by a Motorola #78M05 or equal with, for example, a 5V-500 ma capability. Power supply components can change depending on power requirements. Software programmable micro-controller, which can be a Motorola #MC68HC705J1A or equal is programmed as desired, in conventional fashion, to activate the luminous tube switching devices to create any desired animated lighting effect. Multiple programs can be entered in the controller and selected at random or at will, either locally or remotely. Programming can occur remotely or locally, fed to programmable device by any desired interface, including wired or wireless network or switched connection. Timing to the micro-controller may be supplied by a National Semiconductor #LM555 or equal which provides the base that software may be written to set animation speeds. A variable resistor can be substituted for a set resistance on the LM555 to change the input timing pulse to micro-controller, thereby affecting the speed of the animated display.

Luminous tube lighted/unlighted selection may be performed by shunting/diverting the voltage and current around the tube through a switching device to create the tube on/off condition. Switching devices can be activated manually or electronically. Shunting of the tube is performed with an opto-isolator, Motorola #MOC3083, 800V-75 ma component to separate the 5V control side voltage from the higher voltage required to ionize the tube. The opto-isolator can be used by itself or in conjunction with a triac Motorola #MAC218A, 800V-8 amp or equal. The triac may be added to reduce the heating effect on the opto-isolator.

Particularly relevant to the present invention are the following aspects of gas discharge tube displays which can be controlled using isolator/switches and combinations of them to control the secondary side of the tube power supply:

Aspect 1: Control of Tubes Operating at Higher Voltage.

Small diameter tubing, such as 8 mm, 10 mm and 12 mm require higher ionization voltages than those of 13 mm through 25 mm. Ionization voltages decrease with each increase in tube outside millimeter diameter. The same relationship holds true for tubes of increasing lengths only inverted. As tubes extend form 0" to a given length, ionization voltage requirements increase with additional length.

Ionization voltage is thereby determined by the combination of tube diameter and length. When tube voltage requirements become too high, the opto-triac combination operates in the shorted/shunted condition thereby not allowing the tube to ionize and be visible for viewing. In order to accommodate voltage requirements higher than a single opto-isolator/triac combination can tolerate, it has been found effective to connect isolator/triac combinations as shown in FIGS. 2 and 3, for example. These connected combinations increase the ionization voltage tolerance/non-shunt condition. As many opto-isolator/triac combinations may be connected in series or otherwise as needed in order to accommodate the tube voltages as determined by diameter and length. The multiple combinations may be controlled simultaneously by the same micro-controller I/O port.

Aspect 2: Higher Current Rating.

The term "neon" when used in conjunction with neon displays usually connotes tubes ranging from 6 mm in diameter to those 15 mm in diameter and driven by 30 ma and 60 ma constant current transformers. The term "cold cathode" usually refers to tubes 18 mm in diameter to 25 mm in diameter driven by 120 ma or higher type transformers. Multiple isolator/switch combinations as mentioned in Aspect 1 allow circuits according to the present invention easily to accommodate and control both "neon" and "cold cathode" displays.

Aspect 3: Methods of Manufacturing.

Because among other things displays according to the present invention require only one power power transformer for a multiple tube animated display, control and power electronics according to the present invention can be contained in a single enclosure with economies in manufacturing steps, time and cost.

Aspect 4: Changeable Micro-Controller.

According to aspects of the invention, an intigrated-circuit socket may be added to allow the plug in/out of controllers, each having different software programs which allows for a much wider variety of viewing displays.

Aspect 5: Seven Segment Displays.

With increased power capability of opto/triac combinations along with expanded micro-controller logic according to aspects of the present invention, it is now possible to produce large, bright, and energy efficient neon/cold cathode information displays and systems. For example, control information can switch a seven-segment display or multiples of seven-segment displays to create an information center, such as, for example, the digital time and temperature system displayed in the front of banks.

Aspect 6: 35 Dot Matrix Displays.

Increased logic and power capabilities provided by aspects of the invention can now control a 35 dot matrix and multiples thereof. The result is usually referred to as a message center type display where information is constantly moving and changing. These systems typically use incandescent lamps (light bulbs) or LED's (light emitting diodes). According to the present invention, however, the "dots" can be created by neon tubes bent in the shape of small "U's" termed double-backs. When viewed from the double-back end, the tube becomes a high intensity light source. Animated television displays such as at sports centers are an example of displays now made possible by aspects of the present invention.

Aspect 7: Color Blending Micro-Controller Software Logic.

Color blending is a phenomenon that makes possible color television. Various colors and hues are produced using multiple units formed of three illumination sources: red, blue and green. In gas discharge tube displays, color blending may be accomplished with the use of red, blue and green neon or cold cathode tubing. Each tube intensity may be controlled by a timed duty cycle written into the software of the controller. Each tube may have a different and varying timed duty cycle. When all three tubes are tied in close proximity and all running at varying intensities, the result can be that there is a production of virtually every color in the light color spectrum. The controller can be used with the opto-isolator/triac combinations according to the present invention or used to cycle the primaries of individual transformers where large volumes of light may be necessary. Color blenders according to the present invention can be used as large screen television type displays at public forums and other suitable locations.

Aspect 8: Remote Programming.

I/O ports are set on the micro-controller to allow online program changes for display. Online display changes can be entered by a distant keyboard type device or information system updated direct from the Internet. This type program change can be used as opposed to that of exchanging preset micro-controllers in integrated-circuit sockets.

Aspect 9: Wireless or Wire Line Program Control.

I/O ports on the micro-controller and the addition of a receiver to the control unit allows for wireless changes entered from the internet or other off location source for constant updates or content feed to displays according to the present invention. It is now possible, for instance, to feed content and or commands to displays according to the present invention via terrestrial air interface, such as via so-called Wi-Fi or IEEE 802.11(b), or satellite feed so that large public animated or television type gas discharge displays, or displays at chain establishments such as restaurants or service stations, may be controlled in real time from a central location.

Aspect 10: More Efficient and Effective Control of Gas Discharge Tubes.

Perhaps more fundamentally, circuits according to the present invention more effectively control gas discharge tubes and thus are better adapted to create displays formed of such tubes. The isolator/switch unit, whether it is a single component or a combination of an isolator and a switch component, which controls the secondary side of the power circuit to the tubes, allows multiple tubes to be powered using one high voltage source, and thus one transformer or a minimal number of transformers. Accordingly, multiple tubes may be formed into an array and thus a dynamic display, with less burdensome requirements for multiple power sources. The isolator/switches, preferably solid state, allow for control without noise effects caused by electro-mechanical devices. Furthermore, they are compatible with low power control signals of the sort generated by micro-processors or microcontrollers which can control the operation and sequencing necessary to generated a coordinated activation/deactivation of the tubes in the array for the desired visual effect. Yet, they isolator aspect of the circuits allows them to accommodate and control high voltage power to the tubes while at the same time accommodating the low power control signals. Any devices or combination of devices which carry out these results are the sorts of components contemplated in the present invention as isolator/switches.

The foregoing description of certain implementations and embodiments has been provided for purposes of disclosing and illustrating the present invention, and should not be construed as limiting the scope of the invention or language in the claims that define the invention.

What is claimed is:

1. A dynamic gas discharge tube display, comprising:

a. at least one power supply having a low voltage side and a high voltage side;

b. a plurality of gas discharge tubes, each coupled to the high voltage side of said power supply;

c. corresponding to each gas discharge tube, at least one non mechanical switch coupled to the gas discharge tube and to the high voltage side of said at least one power supply, said switch adapted to remove voltage from said gas discharge tube;

d. a programmable controller containing a program adapted to selectively illuminate at least some of said plurality of gas discharge tubes without illuminating other of said tubes in order to create a dynamic visual display; and e. at least one non-mechanical opto isolator coupling each nonmechanical switch to said controller, whereby the controller is adapted to control operation of said switches without being exposed to high voltage from the high voltage side of said at least one power supply;

f. whereby the controller is adapted to selectively control the illumination of the plurality of gas discharge tubes and thereby present a dynamic visual gas discharge tube display by selectively removing voltage from the high voltage side of said at least one power supply from each of said tubes; and g. whereby the controller is adapted to control the selective illumination of the plurality of gas discharge tubes without the requirement for a separate power supply for each tube.

2. A display according to claim 1 wherein at least some of said power supplies are transformers.

3. A display according to claim 1 wherein at least some of said switches are triac semiconductor devices.

4. A display according to claim 1 wherein at least some of said switches are field effect transistors.

5. A display according to claim 1 wherein at least some of said isolators and said switches constitute a single device which comprises an isolator and a switch.

6. A display according to claim 1 in which at least some of the switches are connected in series with their corresponding tubes.

7. A display according to claim 1 in which the controller is a programmable device.

8. A display according to claim 7 in which the controller is programmable remotely.

9. A display according to claim 8 in which the controller is adapted to receive content from a remote source for display by the display.

10. A display according to claim 1 in which the tubes form a plurality of 7 segment display units.

11. A display according to claim 1 in which the tubes form a plurality of 35 dot matrix display units.

12. A display according to claim 1 in which the tubes are arranged to perform color blending.

13. A display according to claim 1 in which each tube is connected to a plurality of switches.

14. A display according to claim 1 in which at least one isolator is coupled to a plurality of switches.

15. A dynamic gas discharge tube display, comprising:

a. at least one power supply having a low voltage side and a high voltage side;

b. a plurality of gas discharge tubes, each coupled to the high voltage side of said power supply;

c. a plurality of isolator/switch devices, each comprising:

a non mechanical switch coupled to a corresponding gas discharge tube and to the high voltage side of said at least one power supply, said switch adapted to remove voltage from said gas discharge tube; and an opto isolator coupling the switch to a controller, whereby the controller is adapted to control operation of the switch without being exposed to high voltage from the high voltage side of said at least one power supply;

d. a programmable controller coupled to said opto isolators and containing a program adapted to control said switches and thereby selectively illuminate of at least some of said plurality of gas discharge tubes without illuminating other of said tubes in order to create a dynamic visual display; and e. whereby the controller is adapted to selectively control the illumination of the plurality of gas discharge tubes and thereby present a dynamic visual gas discharge tube display by selectively removing voltage from the high voltage side of said at least one power supply from each of said tubes; and f. whereby the controller is adapted to control the selective illumination of the plurality of gas discharge tubes without the requirement for a separate power supply for each tube.

16. A display according to claim 15 where in each tube is coupled to a plurality of isolator/switch devices.

17. A dynamic neon tube display, comprising:

a. a transformer having a low voltage side and a high voltage side;

b. a plurality of neon tubes, each coupled to the high voltage side of the transformer;

c. a plurality of isolator/switch devices, each comprising:

a non mechanical switch coupled to a corresponding neon tube and to the high voltage side of the transformer, said switch adapted to remove power from said neon tube; and an opto isolator coupling the switch to a controller, whereby the controller is adapted to control operation of the switch without being exposed to high voltage from the high voltage side of the transformer;

d. a programmable controller coupled to said opto isolators and containing a program adapted to control said switches and thereby selectively illuminate at least some of said plurality of neon tubes without illuminating other of said tubes and thereby create a dynamic visual display; and e. whereby the controller is adapted to selectively control the illumination of the plurality of neon tubes and thereby present a dynamic visual neon tube display by selectively removing voltage from the high voltage side of the transformer from each of said tubes; and f. whereby the controller is adapted to control the selective illumination of the plurality of neon tubes without the requirement for a separate transformer for each tube.

* * * * *